US007165595B2

(12) United States Patent
Yamamoto

(10) Patent No.: US 7,165,595 B2
(45) Date of Patent: Jan. 23, 2007

(54) SECURITY DOOR APPARATUS

(75) Inventor: Shusaku Yamamoto, Kobe (JP)

(73) Assignee: Brande Co., Ltd., Kobe (JP)

( * ) Notice: Subject to any disclaimer, the term of this patent is extended or adjusted under 35 U.S.C. 154(b) by 77 days.

(21) Appl. No.: 10/807,586

(22) Filed: Mar. 24, 2004

(65) Prior Publication Data

US 2004/0206000 A1 Oct. 21, 2004

(30) Foreign Application Priority Data

Apr. 16, 2003 (JP) ..... 2003-111169

(51) Int. Cl.
*E06B 3/32* (2006.01)

(52) U.S. Cl. ..... 160/97; 49/70

(58) Field of Classification Search ..... 160/97, 160/96, 92, 98, 102, 103, 95, 206; 49/70
See application file for complete search history.

(56) References Cited

U.S. PATENT DOCUMENTS 1,204,833 A * 11/1916 Warfel ..... 160/97
1,479,312 A * 1/1924 O'Harrow ..... 160/97
2,455,112 A * 11/1948 Christison ..... 160/32
2,537,896 A * 1/1951 Hinton et al. ..... 292/1
4,103,458 A * 8/1978 Booker ..... 49/56
4,589,463 A * 5/1986 Ryan ..... 160/88
5,660,144 A * 8/1997 Venti ..... 119/416
5,927,011 A * 7/1999 Sickenius ..... 49/56
6,089,302 A * 7/2000 Britt ..... 160/98
6,357,509 B1 * 3/2002 Lamazares ..... 160/210

FOREIGN PATENT DOCUMENTS

JP 9-317347 A 12/1997
JP 10-227186 A 8/1998

* cited by examiner

*Primary Examiner*—David Purol
(74) *Attorney, Agent, or Firm*—Birch, Stewart, Kolasch & Birch, LLP

(57) ABSTRACT

The entrance security door apparatus has the object of providing security for the receiver in a condominium, etc., when the receiver must confirm an unexpected visitor, etc., by opening and closing a door such as entrance door. A locking tool is provided so that the door can be opened and closed to the side end side of a door opening frame, wherein the security door apparatus comprises: one side end part of an auxiliary door having a predetermined narrow width is connected to the inner side of the open/close side of the door and the other side end part of the auxiliary door is connected to the inner part of the side end of the open/close side of the door opening frame, and the auxiliary door is linked in such a manner that. When the door is opened, the auxiliary door functions as a barrier in the opening part between the door and the door opening frame. The auxiliary door is formed to have a lattice-shape shape, etc., so that the receiver can visually confirm the outside from the interior.

12 Claims, 4 Drawing Sheets

SECURITY DOOR APPARATUS

CROSS REFERENCE TO RELATED APPLICATION

This Nonprovisional application claims priority under 35 U.S.C. § 119(a) on Patent Application No(s). 2003-111169 filed in JAPAN on Apr. 16, 2003, the entire contents of which is hereby incorporated by reference.

FIELD OF THE INVENTION

The present invention relates to a security door apparatus for a condominium, a single-family house, and other entrance doors in the building field.

BACKGROUND OF THE INVENTION

Recently, there have been ill-intentioned visitors to condominiums or single-family houses disguised as a door-to-door delivery person or a door-to-door sales person. Once the entrance door is opened, such an unwanted visitor may prove difficult to turn away or may in fact turn out to be an intruder.

To prevent this, a door scope or a TV camera, etc., at the entrance door has been used to confirm the identity of the visitor. However, such a device does not allow the receiver to confirm the entire image of the visitor easily and sufficiently. When the identity of the visitor is confirmed via the opening part between a door and a door opening frame joined by a door chain, the opening part is very narrow and thus the receiver must open the door completely since he/she cannot receive a delivered package, etc. This has been a cause of difficulty in anticrime measures.

In view of the above, a patent search was carried out with regards to the security of an entrance door. Search results found Japanese Published Unexamined Patent Application No. 9-317347 and Japanese Published Unexamined Patent Application No. 10-227186.

The former publication of Japanese Published Unexamined Patent Application No. 9-317347 suggests a security double door in which an inner door that can be integrally opened with an external door is provided so that a receiver can confirm a visitor while only the inner door is opened. The latter publication of Japanese Published Unexamined Patent Application No. 10-227186 suggests that a door body has at the center part an opening part that has an auxiliary door opened toward the residence interior side through which postal matter or a package is received.

However, both of the publication can be applied to a newly-provided door but are difficult to be applied to an existing door, because these publication require a door to have an opening in which an inner door is provided. These publication do not allow the receiver to safely confirm the entire image of a visitor easily and sufficiently.

Means for Solving the Problems

The present invention was made in view of the above. In order to solve the above problems, the first object is to provide a security door apparatus for an entrance door, etc., in which a locking tool is provided so that the door can be opened and closed to the side end side of a door opening frame, wherein the security door apparatus comprises: one side end part of an auxiliary door having a predetermined narrow width is connected to the inner side of the open/close side of the door and the other side end part of the auxiliary door is connected to the inner part of the side end of the open/close side of the door opening frame, and the auxiliary door is linked in such a manner that, when the door is opened, the auxiliary door functions as a barrier in the opening part between the door and the door opening frame; and the auxiliary door is linked in such a manner that, when the door is opened, the auxiliary door functions as a barrier in the opening part between the door and the door opening frame; and the auxiliary door is lattice-shaped or louver-shaped so that a receiver can visually confirm the outside from interior.

By the structure as described above, even in a situation where the receiver has to open the door to greet an unexpected door-to-door delivery person a door-to-door sales person, the lattice-shape auxiliary door is positioned as a barrier between the door and the door opening frame so that the receiver can sufficiently confirm the identity of the person on the outside through between the lattice of the auxiliary door. In this way, the receiver can ensure a secure environment in which the receiver can judge the visitor in a composed manner without being caught off guard. The receiver also can correctly listen to the voice of the visitor through the opened door. The entrance security door apparatus of the present invention also can be easily applied to an existing door if needed.

Another object of the present invention is to provide a security door apparatus wherein both side end parts of the auxiliary door are rotatably connected to one side end part of the door and one side end part of the door opening frame, respectively, and one side end part of the auxiliary door is slidably provided at one side end part of the door or one side end part of the door opening frame so that one side end part of the auxiliary door can be opened and closed in accordance with the opening and closing of the door. Thus, the auxiliary door can be positioned as a barrier between the door and the door opening frame.

Still another object of the present invention is to provide a security door apparatus wherein one side end part of the auxiliary door is attachably and detachably provided at one side end part of the door or at one side end part of the door opening frame. When the auxiliary door is not required, an engagement/disengagement lever can be operated to lock the auxiliary door to the door side so that the door can be opened and closed conventionally.

Still another object of the present invention is to provide a security door apparatus wherein one side end part of the auxiliary door of aluminum or iron having a narrow width has axial support parts at the upper and lower parts, whereby these axial support parts are attachably and detachably attached to locking bearing parts that are provided at the upper and lower end parts of the door opening frame or the inner surface of the door, and the axial support parts are formed at the upper and lower parts of the other side end part of the auxiliary door, and these axial support parts provided at the upper and lower parts of the door or the inner surface of the door opening frame are slidably attached to slide guides having a predetermined length.

This allows one side end part of the auxiliary door to be pivotally supported at the upper and lower parts of the door opening frame or the door and allows the other side end part to slide along the slide guides provided at the upper and lower parts of the inner surface of the door or the door opening frame side, thus allowing the auxiliary door to be opened and closed in accordance with the opening and closing of the door.

The present invention also provides a security door apparatus wherein a notch part is provided at the contacting part of the door lock knob of the auxiliary door in order to prevent the auxiliary door from making contact with the door lock knob so that the auxiliary door can be opened and closed without causing the door lock knob to make contact with the auxiliary door.

Furthermore, the present invention provides a security door apparatus wherein the auxiliary door is formed to be foldable so that both side end parts of this auxiliary door are rotatably connected to one side end parts of the door and the door opening frame, respectively and/or at least the upper half part of the auxiliary door has a lattice-shape or louver-shape structure through which a receiver can confirm the outside. Thus, the slide guide is eliminated to provide the auxiliary door with a simplified structure and, the auxiliary door is positioned as a barrier between the door and the door opening frame, and through between the lattice of the auxiliary door, the receiver can sufficiently confirm the outside.

Still furthermore, the present invention provides a security door apparatus wherein one side end part of the auxiliary door is attachably and detachably provided at one side end part of the door or at one side end part of the door opening frame, a width of the auxiliary door is formed slightly larger than the width of a delivered package for a door-to-door delivery, etc., and this auxiliary door partially is provided with openably and closably an opening and closing window through which the package is received. When the auxiliary door is not required, then the engagement/disengagement lever can be operated to lock the auxiliary door at the door side so that the door can be opened and closed conventionally. A width of the auxiliary door is formed slightly larger than the width of a delivered package for door-to-door delivery, etc., and this auxiliary door partially is provided with an opening and closing window through which the package is received. This allows, even when the auxiliary door is positioned as a barrier between the door and the door opening frame, the receiver to receive a delivered package by the opening and closing window provided in the auxiliary door, thus providing increased security.

Still furthermore, the present invention also provides a security door apparatus wherein the auxiliary door is provided with the locking tool for locking the locking tool of the door or the locking tool is surrounded by a cover in order to prevent the locking tool of the door from being subjected to lock-picking or the locking tool of the door has at the inner side of the locking part a locking tool for sandwiching the thumbturn part of the locking part to provide a locked status that is slidably or rotatably provided at the auxiliary door. Thus, the door locking tool can be prevented from being subjected to lock-picking via the auxiliary door and the thumbturn of the locking tool can be prevented from being rotated, thus providing increased security.

Further scope or applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DETAILED DESCRIPTION OF THE INVENTION

A security door apparatus of this invention is characterized by providing a locking tool so that the door can be opened and closed to the side end side of a door opening frame, wherein the security door apparatus comprises: one side end part of an auxiliary door having a predetermined narrow width is connected to the inner side of the open/close side of the door and the other side end part of the auxiliary door is connected to the inner part of the side end of the open/close side of the door opening frame, and the auxiliary door is linked in such a manner that, when the door is opened, the auxiliary door functions as a barrier in the opening part between the door and the door opening frame; and the auxiliary door has a lattice-shape or louver-shape so that a receiver can visually confirm the outside from the interior.

Figure 1:
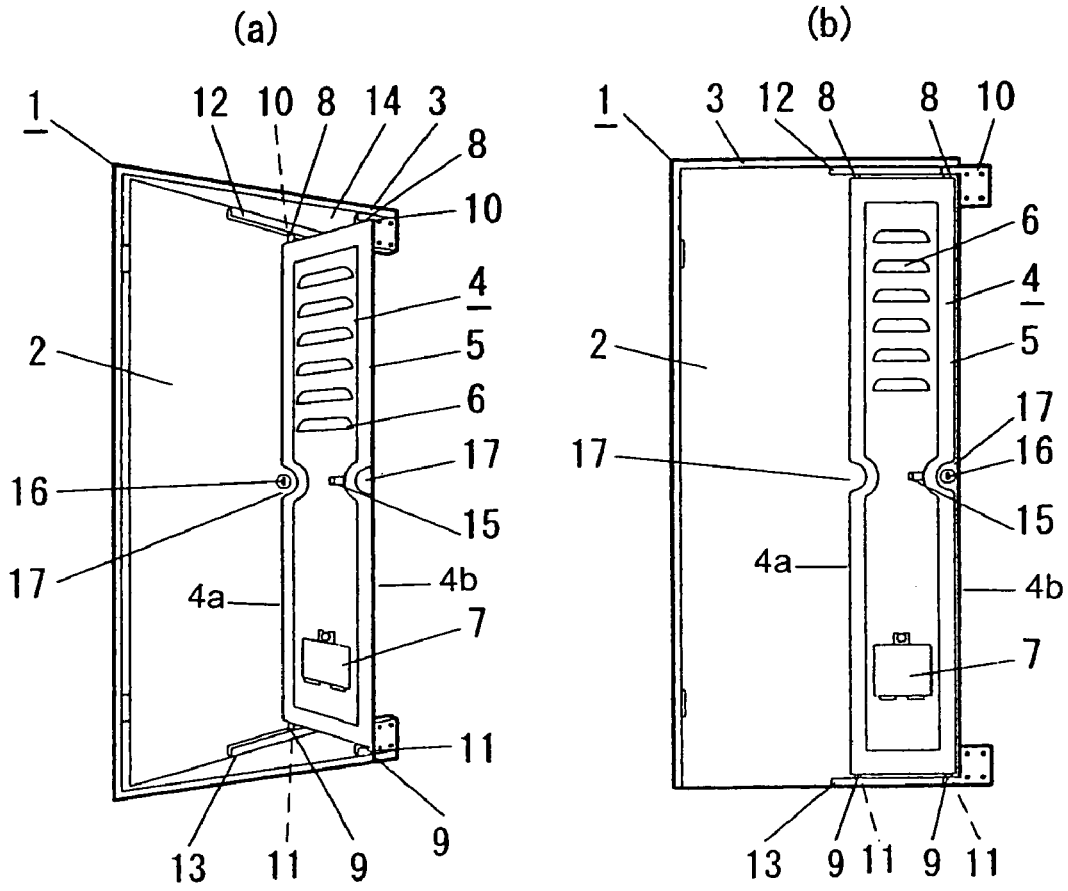
FIG. 1 is a perspective view (a) illustrating one embodiment of the entrance security door apparatus of the present invention and an inner view (b)

As shown in FIGS. 1(*a*) and (*b*), the security door apparatus of the present invention of the door 2 for an entrance and the door opening frame 3 are connected to the auxiliary door 4, and when a visitor opens the door 2, the auxiliary door 4 separates an exterior and an interior so that security is provided.

As shown in FIGS. 1(*a*) and (*b*), it is preferable that the structure of the above auxiliary door 4 comprises, a predetermined small width that is slightly wider than the width of a typical delivered package for a door-to-door delivery, for example, wherein the rigid frame body 5 is provided with the lattice or louver 6, for example, at least at the upper half part, and so a receiver can confirm the outside from the interior such as lattice door to ensure security. It is also especially preferable that the opening and closing window 7 be provided at least at the lower half part of the rigid frame body 5, thus enabling a delivered package to be received. The window 7 may be openable and closable from the indoor side of the auxiliary door 4.

Figure 2:
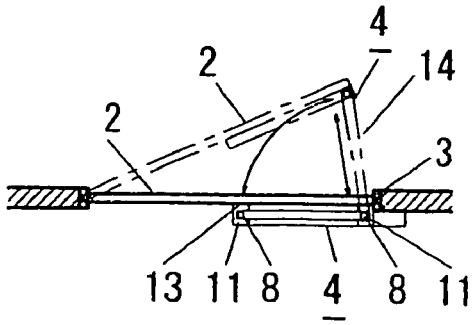
FIG. 2 is a cross-sectional view illustrating the opening/closing mechanism of the same above.

As shown in FIG. 1 and FIG. 2, the axial support parts 8 and 9 are provided in a projected manner in the two upper corners and the two lower corners of the auxiliary door. A pair of lock bearing parts 10 and 11 are provided at the upper and lower parts of the inner side part of the side end of the open/close side of the door 2. Additionally, another pair of lock bearing parts 10, 11 is provided at the upper and lower parts of the inner side of the side end part of the open/close side of the door opening frame 3. These four locking bearing parts 10 and 11 are engaged with the four axial support parts 8 and 9 of the auxiliary door 4, so that a second side 4*b* of the auxiliary door 4 is connected to the door opening frame 3, and so that a second side 4*a* of the auxiliary door 4 is connected to the door 2.

As shown in FIG. 1 and FIG. 2, the upper and lower parts of the door 2 are provided with the slide guides 12 and 13 having a predetermined length to which the pair of the locking bearing parts 10 and 11 of the above-described door 2 side are slidably attached. As shown in FIG. 1(*a*), this allows the auxiliary door 4 to be positioned across the opening 14 between the door 2 and the door opening frame 3 in accordance with the opening and closing of the door 2. As a result, the interior and the exterior can be securely separated by the auxiliary door 4 even when the door 2 is opened, thus providing security.

The pair of locking bearing parts 10 and 11 on the door 2 preferably have a cylindrical shape so that the locking bearing parts 10 and 11 are rotatably engaged with the slide guides 12 and 13. However, this may be optional. The slide guides 12 and 13 also have a position stopper (not shown) for limiting or adjusting the opening and closing of the auxiliary door 4, and so that the opening and closing of the auxiliary door 4 can be adjusted.

Figure 3:
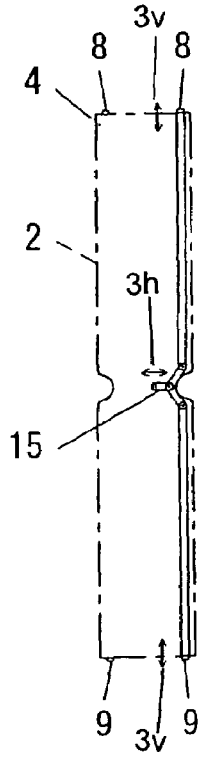
FIG. 3 is a diagram illustrating the engagement/disengagement of an axially supported part of the auxiliary door, FIGS. 4 (*a*), (*b*) illustrate how the locking device of the door prevents lock-picking of the same above, FIGS. 5 (*a*), (*b*) are cross-sectional views illustrating another embodiment of the same above.

The axial support parts 8 and 9 on the second side 4*b* of the above auxiliary door 4 are linked as shown in FIG. 3, so as to be connected to the engagement/disengagement lever 15. As a result, these two axial support parts 8 and 9 can be engaged with or disengaged from the locking bearing parts 10 and 11 of the door opening frame 3 by operating the engagement/disengagement lever 15. As can be seen in FIG. 3, moving the engagement/disengagement lever 15 in a horizontal direction (horizontal arrows 3*h*) will cause the support parts 8 and 9 to engage with or disengage from (vertical arrows 3*v*) the locking bearing parts 10 and 11 of the door opening frame 3. When the axial support parts 8 and 9 are disengaged from the locking bearing parts 10 and 11 of the door opening frame 3, the door 2 can be conventionally opened or closed from/toward the door opening frame 3. When the axial support parts 8 and 9 are disengaged from the locking bearing parts 10 and 11, the auxiliary door 4 is preferably locked to the door 2 via an appropriate locking part (not shown), etc. Here, a contact part of the auxiliary door 4 provided with a locking knob 16 of the door 2 may have an appropriate means, such the notch part 17, as shown in FIG. 1 and FIG. 2.

Figure 4:
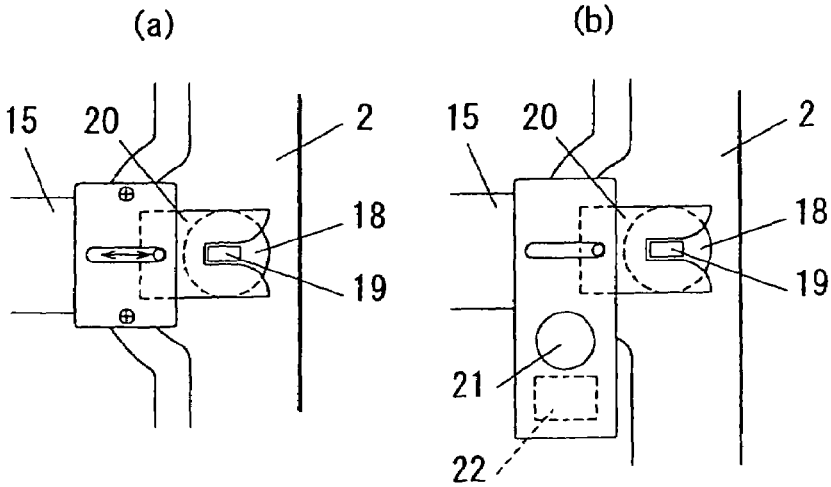

As shown in FIG. 4(*a*), the auxiliary door 4 also has a locking tool 20 that provides a locked state by sandwiching the locking part 19 slidably and rotatably provided at the locking part 19 of the interior for the locking tool 18 of the door 2. This provides a further security means for preventing the locking tool 18 of the door 2 from being subjected to lock-picking. When the locking part 19 cannot be sandwiched, then an effective and appropriate means may be provided, such as a means for covering or surrounding the locking part 19.

As shown in FIG. 4(*b*), the locking tool 20 also may have an auto-lock part 21, such as a motor, so that the locking tool 20 can be locked or unlocked by remotely controlling the controller 22 from the outside of the door 2.

Figure 5:
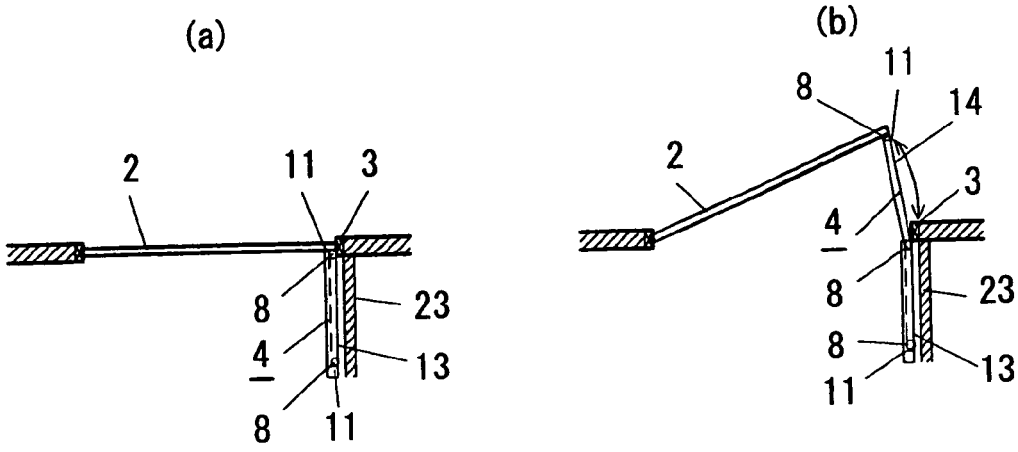

As shown in FIGS. 5(*a*) and (*b*), for the above-described auxiliary door 4, the slide guides 12 and 13 for sliding are provided at the side wall 23 side of the door opening frame 3 side. As shown in FIGS. 5(*a*) and 5(*b*), the auxiliary door 4 can be slidably provided at the door side or at the door opening frame side.

Figure 6:
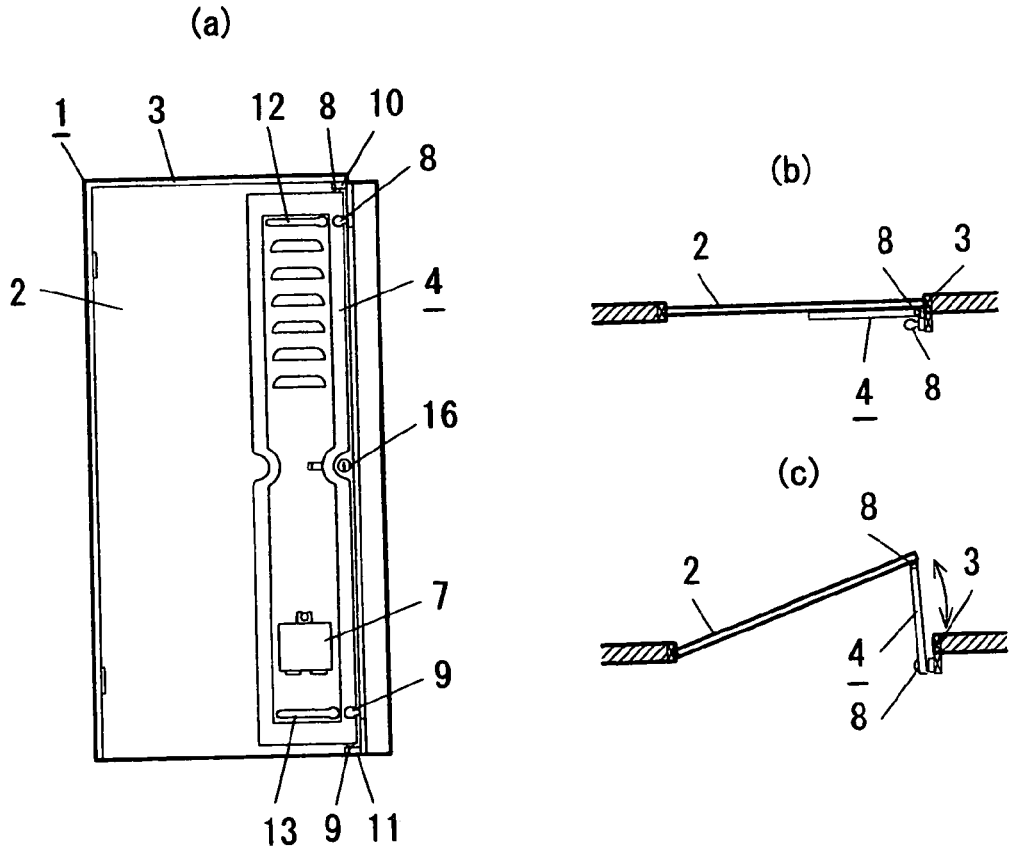
FIG. 6 is an inner view (a) illustrating still another embodiment of the same above, and cross-sectional views (b) and (c) illustrate how the entrance security door apparatus is opened or closed, FIGS. 7 (*a*), (*b*) are cross-sectional views illustrating still another embodiment of the same above.

As shown in FIGS. 6(*a*) and (*b*), the above-described auxiliary door 4 has the slide guides 12 and 13 at the upper and lower parts and the door opening frame 3 side has the axial support parts 8 and 9 that are provided to be engageable with or disengageable from the slide guides 12 and 13. As shown in FIG. 6(*c*), the slide guides 12 and 13 of the auxiliary door 4 are engaged with the axial support parts 8 and 9 at the door opening frame 3 side so that the auxiliary door 4 can function as a barrier.

Figure 7:
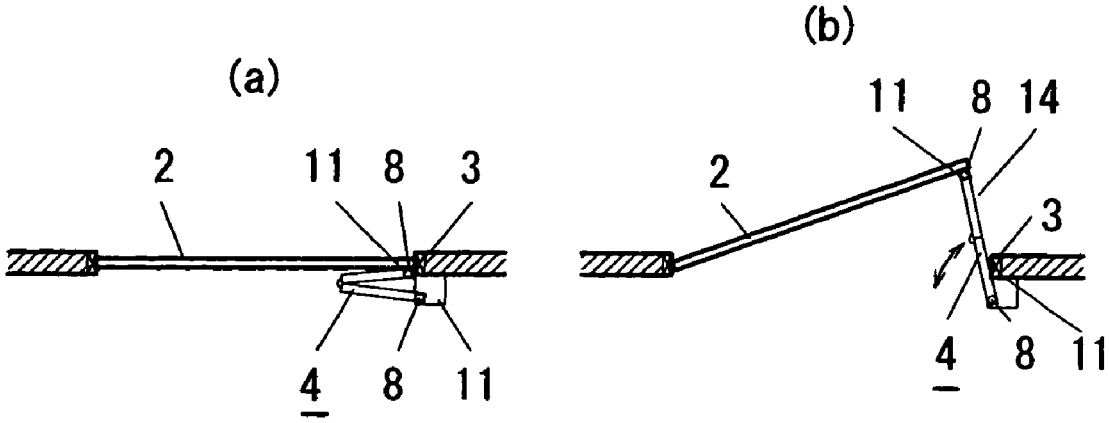

Further, as shown in FIGS. 7(*a*) and (*b*), the auxiliary door 4 is formed to be foldable so that both side end parts of this auxiliary door 4 are attached to the side end part of the open/close side of the door 2 as described above and the locking bearing parts 10 and 11 at the upper and lower parts of the inner side part of the door opening frame 3 (so that one side end part can be attached and detached).

Figure 8:
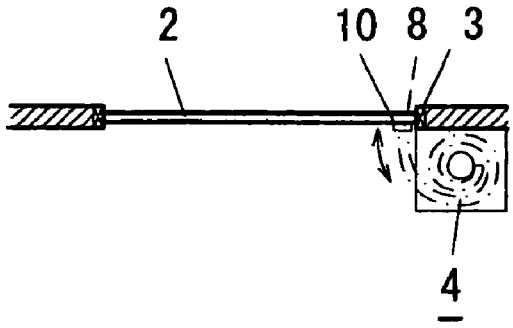
FIG. 8 is a cross-sectional view illustrating still another embodiment of the same above.

Furthermore, as shown in FIG. 8, the auxiliary door 4 is a flexible structure such as a roll shutter in which at the door opening frame 3 the roll shutter-like auxiliary door 4 is wound in the inner side part of the longitudinal direction so that the free end part of this auxiliary door 4 is attachably and detachably connected to the side end part of the open/close side of the door 2 by the means, etc., described above.

As described above, the entrance security door apparatus of the present invention may be applied to other embodiments in accordance with the object of the present invention. Such embodiments include one in which the auxiliary door has a lattice that is expandable and retractable in parallel. The entrance security door apparatus of the present invention also may be applied to other doors other than an entrance door for a condominium and a single-family house.

EMBODIMENTS

FIG. 1 to FIG. 4 illustrate one embodiment of the entrance door of the present invention for a condominium, etc. The auxiliary door 4 is made of aluminum or iron with a width of 400 mm. The surrounding frame body 5 has the integrally-provided louver 6 at the upper half part and the opening and closing window 7 having a size of 300×280 mm at the lower half part is provided openably and closably from the inner side. The auxiliary door 4 has the inner rod-shaped axial support parts 8 and 9 provided to have a length that is almost half of the height of the auxiliary door 4 at both side end parts. As shown in FIG. 3, the inner side end of the axial support parts 8 and 9 is protruded to the engagement/disengagement lever 15 so that the auxiliary door 4 can be linked in a retractable manner. As can be seen in FIG. 3, moving the engagement/disengagement lever 15 in a horizontal direction will cause the support parts 8 and 9 to engage with or disengage from the locking bearing parts 10 and 11 of the door opening frame 3.

The axial support parts 8 and 9 at both upper and lower side ends of this auxiliary door 4 are engaged with: the plate-shaped slide guides 12 and 13 that are provided at the upper and lower parts of the inner side surface of the door 2 and that have an overturned U-shaped cross part; and the locking bearing parts 10 and 11 at the inner side of the open/close side of the door opening frame 3, respectively. As a result, in accordance with the opening and closing of the door 2, the auxiliary door 4 is positioned to work as a barrier between the door 2 and the door opening frame 3. The auxiliary door 4 has a circular arc-shaped notch part 17 at the center so that the auxiliary door 4 can be smoothly opened and closed without making contact with the knob 16 of the door 2.

As shown in FIGS. 4(*a*) and (*b*), the auxiliary door 4 also has the locking tool 20 that sandwiches the locking part 19 of the door 2 to lock the locking part 19 and that is provided in a slidable manner. This prevents the locking part 19 of the door 2 from being subjected to lock-picking.

The construction as described above allows, even when an unexpected door-to-door delivery person, or a door-to-door sales person visits a receiver and the receiver has to unlock the door 2 to open the door 2, the auxiliary door 4 becomes positioned as a barrier between the door 2 and the door opening frame 3, as shown in FIG. 1(*a*), so that the receiver can confirm the identity of the person on the outside through the louver 6 of the auxiliary door 4 while conversing with the visitor. In this way, the receiver can ensure a secure environment in which the receiver can judge the visitor in a composed manner without being caught off guard.

When the auxiliary door 4 is not required, then the engagement/disengagement lever 15 can be operated to retract the axial support parts 8 and 9 so that the axial support parts 8 and 9 can be unlocked from the locking bearing parts 10 and 11. As a result, the door 2 can be opened and closed conventionally by locking the auxiliary door 4 to the locking part at the door 1 side of the door 2.

Furthermore, the locking tool 20 of the auxiliary door 4 can be used to lock the locking part 19 of the door 2 to prevent lock-picking, thus providing further security.

FIGS. 5(*a*) and (*b*) illustrate another embodiment of the present invention in which the slide guides 12 and 13 of the auxiliary door 4 of the above embodiment are provided at the inner side wall 23 of the door opening frame 3. This also provides security s describe above.

FIGS. 6(*a*) to (*c*) show still another embodiment of the present invention. In this embodiment, auxiliary door 4 has the slide guides 12 and 13 at the upper and lower parts and has the axial support parts 8 and 9 that are attached to the slide guides 12 and 13 in an engageable or disengageable manner at the door opening frame 3. As shown in this embodiment, the auxiliary door 4 also may be attached with the slide guides 12 and 13 so that the axial support parts 8 and 9 may be engaged with the slide guides 12 and 13.

FIGS. 7(*a*) and (*b*) show still another embodiment of the present invention. In this embodiment, the auxiliary door 4 is formed to be foldable, and the upper and lower parts of axial support parts 8 and 9 of both side end parts thereof are attached to the side end part of the open/close side of the door 2, and the locking bearing parts 10 and 11 provided at the upper and lower parts of the inner side part of the door opening frame 3. This embodiment eliminates the slide guide and can provide an auxiliary door having a simple structure.

FIG. 8 shows still another embodiment of the present invention in which the auxiliary door 4 has a flexible structure like a roll shutter. The auxiliary door 4 in this embodiment is provided by jointing strips so that the auxiliary door 4 is wound in the door opening frame 3 in the longitudinal direction to allow the free end part of this auxiliary door 4 to be attachably and detachably connected to the side end part of the open/close side of the door 2. As described above, the auxiliary door can have an appropriate shape in accordance with the customer, including a sheet-like shape, a foldable-shape, a roll shape, and a shape that is linked to be expandable and retractable in parallel. In this way, the auxiliary door can have an appropriate and fashionable design in accordance with the door.

What is claimed is:

1. A security door apparatus that is openable and closable with respect to one side of a door opening frame, the security door apparatus comprising:

an entrance door;

an upper horizontal slide guide and a lower horizontal slide guide disposed on one of an inner side of the entrance door or on a side of the door opening frame;

a rectangular-shaped auxiliary door having a width that is smaller than a width of the entrance door, the auxiliary door having an upper and a lower corner on a first side connected to the horizontal slide guides disposed on the one of the inner side of the entrance door or the door frame opening frame, and an upper and a lower corner on a second side connected to a side of the entrance door or the door opening frame not having the horizontal slide guides, wherein the auxiliary door is mounted on the entrance door and the door opening frame so that, and when the entrance door is opened, the auxiliary door forms a barrier across an opening between the entrance door and the door opening frame, thereby preventing a person outside of the auxiliary door from entering through the opening; and wherein the auxiliary door has multiple openings formed so that a person inside the auxiliary door can visually confirm an the person outside of the auxiliary door through the openings in the auxiliary door.

2. The security door apparatus according to claim 1, wherein the upper and the lower corner on the first side of the auxiliary door are rotatably connected to the entrance door and the upper and the lower corner on the second side of the auxiliary door are rotabably connected to the door opening frame, and wherein one of the first side or the second side of the auxiliary door is slidable with respect to the horizontal slide guides disposed on either the entrance door or the door opening frame, thus enabling the slidable side of the auxiliary door to be opened and closed when the entrance door is opened and closed.

3. The security door apparatus according to claim 2, wherein one of the first side or the second side of the auxiliary door is detachably mounted on one of the entrance door or the door opening frame, and is located so as to be positioned at the inner side of the door.

4. The security door apparatus according to claim 3, further comprising:

upper and lower locking bearing parts provided on both the entrance door and the door opening frame; and axial support parts provided at the four corners of the auxiliary door, wherein the axial support parts on one of the first side and second side of the auxiliary door are detachably mounted to the locking bearing parts on the door opening frame or the door, and wherein the axial support parts formed on the other of the first and second side of the auxiliary door are slidably attached to the horizontal slide guide.

5. The security door apparatus according to claim 3, further comprising a notch provided on each of the first side and the second side of the auxiliary door, the notches being provided so that the auxiliary door does not make contact with a door lock knob of the entrance door when the auxiliary door is in open and closed positions.

6. The security door apparatus according to claim 3, wherein the openings are formed in an upper half part of the auxiliary door, the openings having a louver-shape structure through which the person inside the auxiliary door can confirm an identify of the person outside the auxiliary door.

7. The security door apparatus according to claim 1, wherein the auxiliary door is provided with a rectangular-shaped window that can be opened and closed, the window being disposed below the multiple openings.

8. A security door apparatus that is openable and closable with respect to one side of a door opening frame, the security door apparatus comprising:

an entrance door;

an upper horizontal slide guide and a lower horizontal slide guide disposed on an inner side of the entrance door;

a rectangular-shaped auxiliary door having a width that is smaller than a width of the entrance door, the auxiliary door having an upper and a lower corner on a first side connected to the horizontal slide guides disposed on the inner side of the entrance door, and an upper and a lower corner on a second side connected to a side of the door opening frame, wherein the auxiliary door is mounted on the entrance door and the door opening frame so that, and when the closed entrance door is opened, the auxiliary door forms a barrier across an opening between the entrance door and the door opening frame, thereby preventing a person outside of the auxiliary door from entering through the opening; and wherein the auxiliary door has multiple openings formed so that a person inside the auxiliary door can visually confirm an identity of the person outside of the auxiliary door through the openings in the auxiliary door.

9. A security door apparatus that is openable and closable with respect to one side of a door opening frame, the security door apparatus comprising:

an entrance door;

an upper horizontal slide guide and a lower horizontal slide guide disposed on a side of the door opening frame;

a rectangular-shaped auxiliary door having a width that is smaller than a width of the entrance door, the auxiliary door having an upper and a lower corner on a first side connected to the horizontal slide guides disposed on the door frame opening frame, and an upper and a lower corner on a second side connected to a side of the entrance door, wherein the auxiliary door is mounted on the entrance door and the door opening frame so that, and when the closed entrance door is opened, the auxiliary door forms a barrier across an opening between the entrance door and the door opening frame, thereby preventing a person outside of the auxiliary door from entering through the opening; and wherein the auxiliary door has multiple openings formed so that a person inside the auxiliary door can visually confirm an identity of the person outside of the auxiliary door through the openings in the auxiliary door.

10. The security door apparatus according to claim 1, wherein the auxiliary door includes a rigid frame body extending from the first side to the second side.

11. The security door apparatus according to claim 8, wherein the auxiliary door includes a rigid frame body extending from the first side to the second side.

12. The security door apparatus according to claim 9, wherein the auxiliary door includes a rigid frame body extending from the first side to the second side.

* * * * *